United States Patent [19]

Ovsyannikov

[11] 3,990,949

[45] Nov. 9, 1976

[54] DEVICE FOR RETURNING REMAINDERS FROM THE PLATFORM TO THE INTERIOR OF A COKE OVEN

[76] Inventor: Anatoly Filippovich Ovsyannikov, ulitsa Kirova, 12, kv. 117, Novokuznetsk Kemerovskoi oblasti, U.S.S.R.

[22] Filed: Nov. 21, 1974

[21] Appl. No.: 525,931

[52] U.S. Cl. ..... 202/241; 201/2; 432/75; 122/379; 15/345; 110/28 L; 110/104 R; 302/17; 302/57

[51] Int. Cl.[2] ..... C10B 43/00

[58] Field of Search ..... 202/241; 201/2; 432/75; 122/379; 15/345, 346, 316, 318, 405; 110/28 L, 104 R; 302/17, 40, 25, 21, 22, 57

[56] References Cited

UNITED STATES PATENTS 2,064,660 12/1936 Haas ..... 15/345 X 2,391,443 12/1945 Bruton ..... 201/2

*Primary Examiner*—James H. Tayman, Jr.

*Attorney, Agent, or Firm*—Steinberg & Blake

[57] ABSTRACT

The arrangement comprises a working member formed by a pair of intercommunicating nozzles of which one nozzle comprises a bellmouth mounted above the oven platform with a certain spacing, facing with its enlarged portion the bottom part of the oven and intimately adjoining this part upon engaging the oven, and the second nozzle is of cylindrical shape and has an ejector communicated with a compressed gas source for reducing pressure within the nozzles, whereby the first nozzle functions as a suction nozzle to collect the remainders of coke from the platform, and the second nozzle functions as a delivery nozzle to project the collected remainders of coke into the oven chamber.

7 Claims, 9 Drawing Figures

DEVICE FOR RETURNING REMAINDERS FROM THE PLATFORM TO THE INTERIOR OF A COKE OVEN

BACKGROUND OF THE INVENTION

The present invention relates to the coke-making industry, and more specifically to an arrangement for removing the remainders of coke from the operating platforms of coke ovens.

The term "remainders of coke" denotes here semi-coke fallen down from a door upon removing it from the oven, the remainders of charge, red hot coke fallen down from the cake, red hot coke entrained from the hearth during the return stroke of a pusher bar, as well as pitch accumulations.

The arrangement may be the most efficiently used in coke ovens when installed at the machine side and mounted on a coke pusher.

Known in the art are arrangements for removing the remainders of coke from the operating platform of a coke oven comprising a working member which is axially displaceable in a horizontal plane relative to the oven and which comprises a mould mounted on a support frame and connected thereto by means of a leverage. The mould is formed by a base plate and folding walls articulated thereto, the walls forming a box when being in the vertical position for collecting the remainders of coke and returning them into the oven chamber during the movement of the pusher bar of a coke pusher.

The mould is displaced by a horizontally extending bar driven by a worm-gear drive, and the arrangement is also provided with an additional drive for placing the mould on the operating platform of the oven (c.f. USSR Inventor's Certificate No. 133857, Int. Cl. C10b 45/00).

Such known arrangements have a number of disadvantages.

The employment of two drives complicates the construction of the arrangement and hampers the control and maintenance.

During the return stroke of the pusher bar of the coke pusher, a part of red hot coke remaining on the oven hearth gets entrained into the mould and is then lost over the operating platform of the oven. This results in a dust-laiden atmosphere and obstruction of the operating platform which is to be cleaned with the employment of manual labour.

In such known arrangement, the mould is mounted on the platform at the oven hearth level, and the installation level of the coke pusher varies from one oven to another relative to the level of the operating platform during the movement of the coke pusher, so that the pusher bar of the coke pusher cannot completely remove the remainders of coke from the mould. In addition, the mould width is substantially greater than that of the pusher bar head, whereby a gap is formed between the bar head and the mould walls, the remainders of coke accumulating in the gap.

The presence of red hot coke in the mould and in the open oven chamber result in the creation of a high-temperature zone which may lead to troubles in the operation of pivots of the mould leverage.

When the mould walls are closed, large lumps of coke may penetrate therebetween, whereby the mould cannot be closed This may result in breakage of the mould leverage or the mould itself and in additional losses of the remainders of coke over the operating platform.

With the above-described construction, the mould has a vertically extending wall at the oven side, whereas the bottom part of the oven, on which a part of the remainders of coke has accumulated, is of an intricate shape so that this part of the coke remainders cannot be received in the mould and will not be removed.

SUMMARY OF THE INVENTION

It is an object of the invention to provide an arrangement for removing the remainders of coke which completely eliminates the employment of manual labour.

Another object of the invention is to provide an arrangement which ensures the complete removal of the remainders of coke.

An important object of the invention is to provide an arrangement which reduces the concentration of dust and smoke of the atmosphere around the oven.

These and other objects are accomplished by the provision of an arrangement for removing the remainders of coke from the operating platform of a coke oven comprising a working member which is axially displaceable in a horizontal plane relative to the oven for collecting and projecting the remainders of coke from the platform into the oven chamber, and a horizontally extending driven bar for effecting said displacement of the working member, wherein, according to the invention, the working member is formed by a pair of intercommunicating nozzles of which the first nozzle comprises a bellmouth mounted above the oven platform with a certain spacing so that the enlarged portion thereof faces the bottom of the oven and intimately adjoins this part when engaging the oven, and the second nozzle is of cylindrical shape and has an ejector connected to a compressed gas source for reducing pressure within the nozzles, whereby the first nozzle functions as a suction nozzle to collect the remainders of coke, and the second nozzle functions as a delivery nozzle to project the collected remainders of coke into the oven chamber, the two nozzles being rigidly interconnected and vertically adjustable on a bar for maintaining said spacing unchanged.

The construction of the working member in the form of a pair of nozzles interconnected by means of a curved pipe ensures both the suction of the remainders of coke and their projection into the oven chamber, the forward end of the bellmouth of the suction nozzle being shaped in such a manner as to intimately embrace the bottom part of the oven to ensure the collection of all remainders of coke. The suction of the remainders of coke into the nozzle and subsequent projection thereof into the oven chamber reduce the concentration of dust and smoke in the atmosphere around the oven. Due to the intimate contact between the bellmouth and the oven, as well as due to the suction, the complete removal of the remainders of coke from the operating platform is ensured without using manual labour.

According to the invention, the horizontally extending bar is preferably provided with vertically extending guides, and the nozzles are rigidly interconnected by means of a curved pipe having projections on the lateral sides thereof cooperating with the said guides during the vertical displacement of the nozzles. This ensures a constant minimum gap between the lower edge of the bellmount of the suction nozzle and the operating platform independently of the difference in levels of the coke pusher and the operating platform when the coke pusher is transported from one oven to another. Thus a maximum possible amount of the remainders of coke can be removed from the operating platform.

In order to enable the cooling down of the lower edge of the bellmouth upon penetrating the mass of the red hot remainders of coke, a chamber preferably adjoins this edge of the bellmouth so as to define a space communicated with a compressed gas source for cooling down the lower edge of the bellmouth during its movement towards the oven. This ensures a long service life of the nozzle and preserves the shape of the edge. Changes in the shape of the edge would otherwise result in a change in the gap between the lower edge and the operating platform of the oven.

In order to reduce the compressed gas consumption, the chamber is preferably provided with a slit directed inwardly of the bellmouth for blowing off the remainders of coke from the bottom portion of the bellmouth into the delivery nozzle, and with apertures directed towards the operating platform and designed for blowing off the remainders of coke from this platform. Due to the fact that the velocity of atmospheric air ejected in the enlarged portion of the bellmouth is lower than that in the narrower portion thereof, a certain amount of the remainders of coke may remain within the bellmouth. This problem may be resolved by increasing the velocity of the atmospheric air being ejected, that is by increasing the compressed gas pressure, which is uneconomical. Therefore, the chamber is provided with a slit to admit compressed gas which blows off the remainders of coke into the narrower portion of the bellmouth.

The use of the apertures ensures the removal of residues of the remainders of coke with compressed air and their feeding to the oven wall, whereat they are entrained in a whirling flow to penetrate into the bellmouth of the nozzle. The complete removal of the remainders of coke from the operating platform is thereby ensured. In addition, compressed gas flows under the mass of the remainders of coke to effect the air suspension thereof so as to improve the suction capacity.

Since accumulations of pitch occur in the bottom part of the oven thus causing the remainders of coke to adhere to each other, while the pressure reduction in the nozzle cannot provide for suction of such pitch-bonded remainders of coke, the top portion of the bellmouth is provided with apertures directed towards the bottom part of the oven and communicated with a compressed gas source to blow off the remainders of coke from the bottom part of the oven into the bellmouth. Therefore, the use of these apertures ensures the removal of the remainders of coke with a lower pressure reduction, and hence, with a lower compressed gas pressure.

According to the invention, the ejector, which comprises an annular whirling ejector, accommodates a ball which is caused to rotate by compressed gas and to vibrate the working member during the removal of the remainders of coke. The vibration of the working member facilitates the introduction of the bellmouth of the suction nozzle into the mass of the remainders of coke and their conveyance within the working member, thereby enabling the reduction of compressed gas consumption.

The horizontally extending bar is displaced along support rollers so that when in the extreme position, it is cantilevered relative to the rollers.

This results in a heavy load imposed on the support rollers, and to relieve the load, the spacing between the rollers could be enlarged with a consequent increase in the size of the whole arrangement.

In order to eliminate this disadvantage, spring compensation means are mounted on the working member body at an acute angle with respect to the operating platform of the oven, the compensation means being connected to the bar to provide a movable support thereof.

BRIEF DESCRIPTION OF DRAWINGS

The invention will be better understood from the following detailed description of a specific embodiment thereof with reference to the accompanying drawings, in which.

DESCRIPTION OF THE PREFERRED EMBODIMENT

Figure 1:
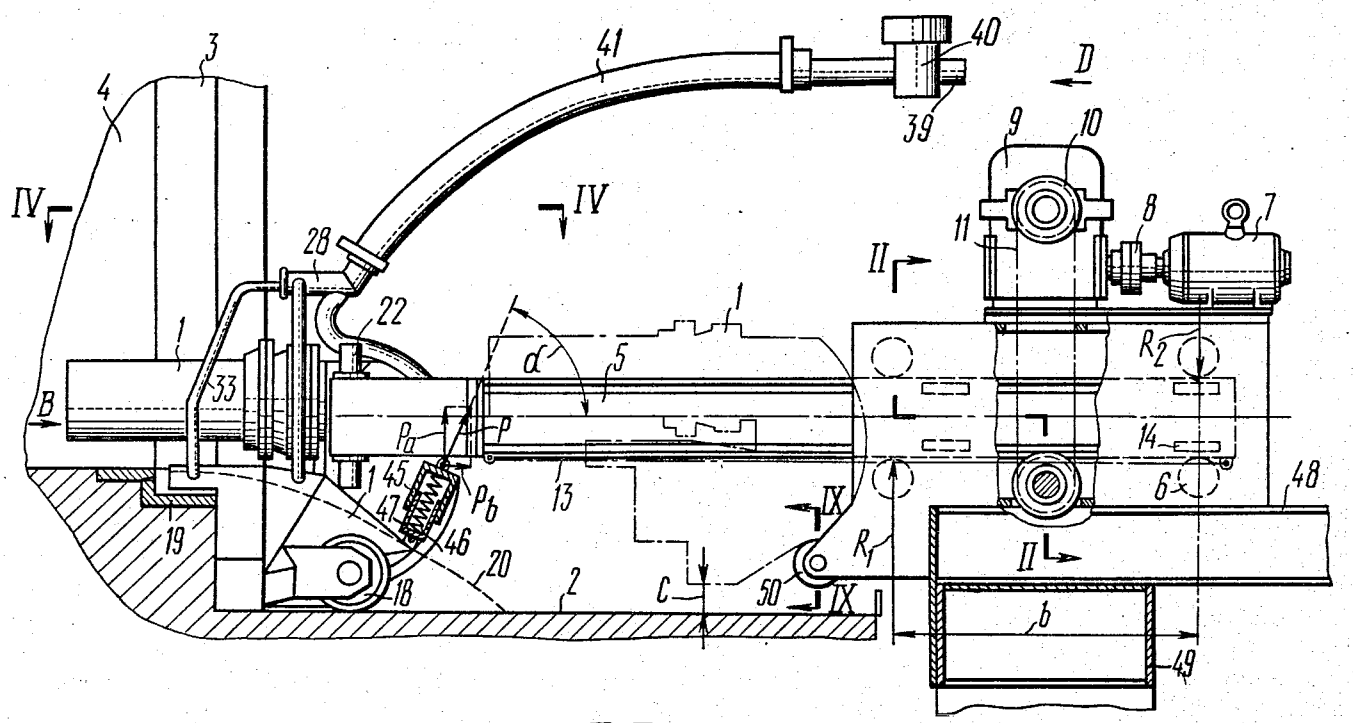
FIG. 1 shows a side elevation view partially in section of an arrangement for removing the remainders of coke according to the invention.

The arrangement for removing remainders of coke according to the invention is located at the machine side of a coke oven and comprises a working member 1 (FIG. 1) which is adapted to collect the remainders of coke from an operating platform 2 of a coke oven 3 to project them into a chamber 4 of the oven, as well as a horizontally extending driven bar 5 which serves for displacing the working member 1 along the operating platform 2. The bar 5 is displaced along support rollers 6 towards the oven by means of an electric motor 7 via a clutch 8, a reduction gear 9, a sprocket 10 and a chain 11, the chain 11 rotating a cluster of sprockets 12 (FIG. 2) of which one sprocket meshes with a chain 13 mounted on the bar 5. The bar 5 is prevented from moving in a horizontal plane by means of rollers 14.

The working member 1 comprises a pair of nozzles of which one comprises a bellmouth 15 (FIG. 3), and an other nozzle 16 is of cylindrical shape, the bellmouth 15 and the nozzle 16 being interconnected by means of a curved pipe 17. The bellmouth 15 is mounted above the operating platform 2 with a certain spacing *a*, this spacing being a minimum one required for unobstructed movement of the working member on wheels 18 along the operating platform of the oven.

The shape of the forward enlarged portion of the bellmouth 15 corresponds to the shape of a bottom part 19 of the oven 3 (FIG. 4) and can intimately adjoin it so as to completely embrace the entire mass of remainders of coke 20 when the working member is engaged with the oven.

In order to ensure a constant minimum spacing *a*, the working member 1 is vertically adjustable on the bar 5. For that purpose, the bar 5 is provided with vertically extending guides 21, each comprising a slot of rectangular crossection, while the lateral sides of the curved pipe 17 are provided with rectangular projections 22 sliding along the guides 21.

With such a construction, the spacing *a* remains unchanged independently of the relative position of levels of a coke pusher and the operating platform when the coke pusher is transported from one oven to another, whereby the most complete removal of the remainders of coke is achieved.

Figure 3:
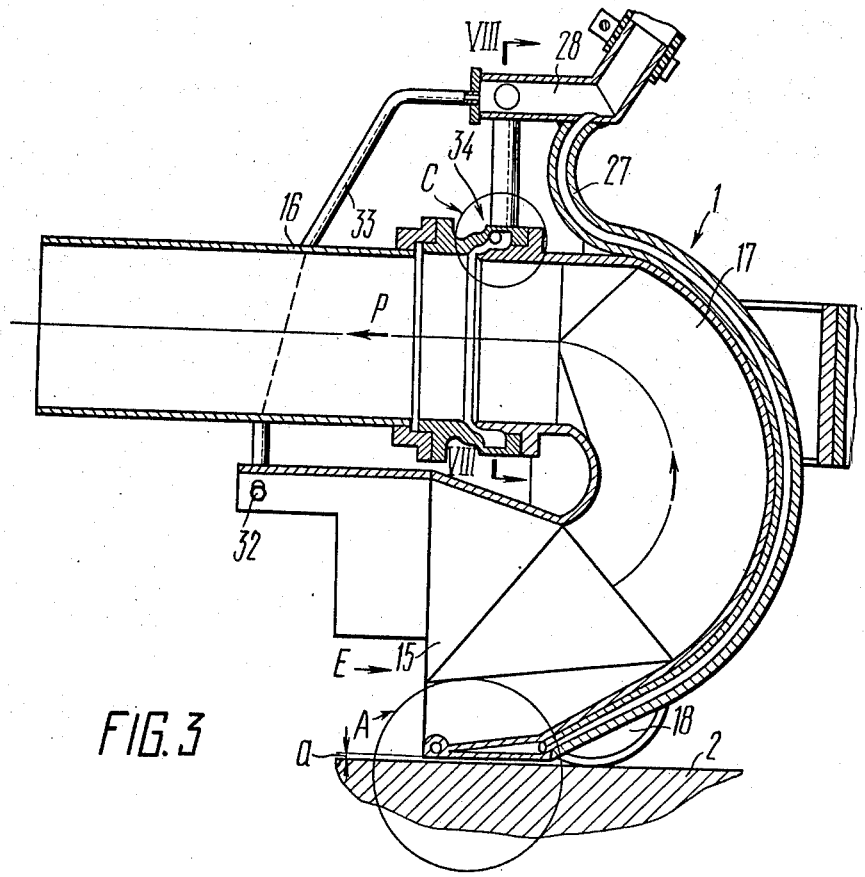
FIG. 3 shows a longitudinal section of the working member.

In order to cool down a lower edge 23 of the bellmouth 15 (FIG. 5), a chamber 24 adjoins this edge to define, together with this edge, a space 25 communicated with a compressed gas source via a space 26, a conduit 27 and a pipe 28 (FIG. 3).

Due to the fact that the remainders of coke may remain on the bottom portion 29 of the bellmouth 15 (FIG. 5), a slit 30 is provided in the chamber 24 extending lengthwise the lower edge and directed inwardly of the bellmouth for blowing off these remainders of coke into the narrower portion of the bellmouth.

For blowing off the remainders of coke remaining on the operating platform of the oven in the space *a*, the chamber is provided with apertures 31 directed towards the platform.

Figure 6:
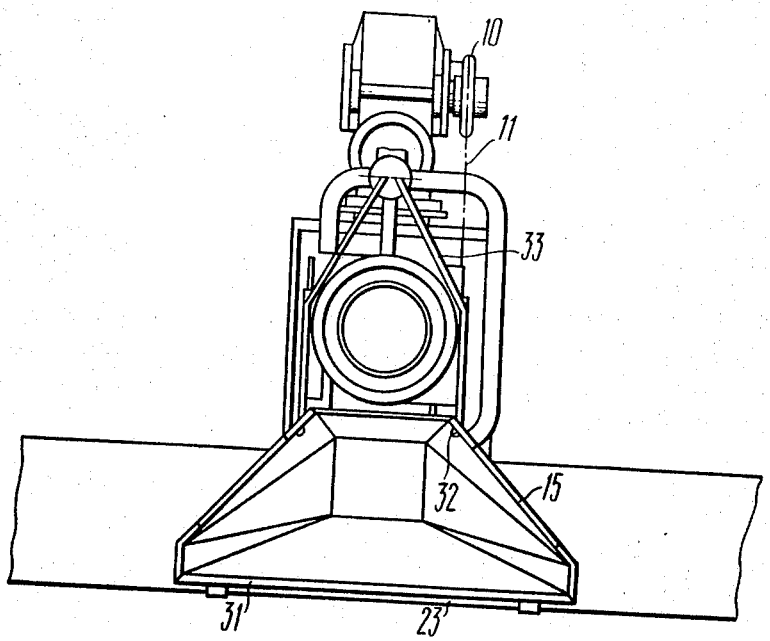
FIG. 6 is a view taken along the arrow "B" in FIG. 1.

Due to the fact that accumulations of pitch occur in the bottom part of the oven which cause the adherence of the remainders of coke to each other, the pressure reduction in the suction nozzle proves to be insufficient for their removal. Therefore, the top portion of the bellmouth 15 is provided with apertures 32 (FIG. 6) directed towards the bottom part 19 of the oven and communicated with a compressed gas source by means of conduits 33 and the pipe 28 (FIG. 3), the compressed gas leaving the apertures 32 blowing off the pitch-bonded remainders of coke into the bellmouth 15.

The nozzle 16 (FIG. 3) accommodates an ejector 34 adapted to reduce the pressure in the bellmouth 15 and in the curved pipe 17. Therefore, the bellmouth 15 functions as a suction nozzle for collecting the remainders of coke 20 from the platform 2, while the nozzle 16 operates as a delivery nozzle for projecting the collected remainders of coke into the oven chamber.

Figure 7:
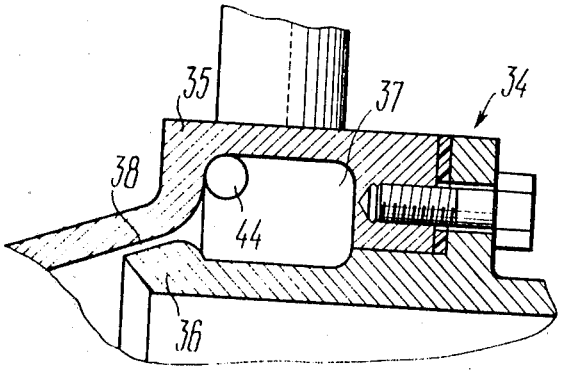
FIG. 7 is a detail "C" in FIG. 3.
Figure 8:
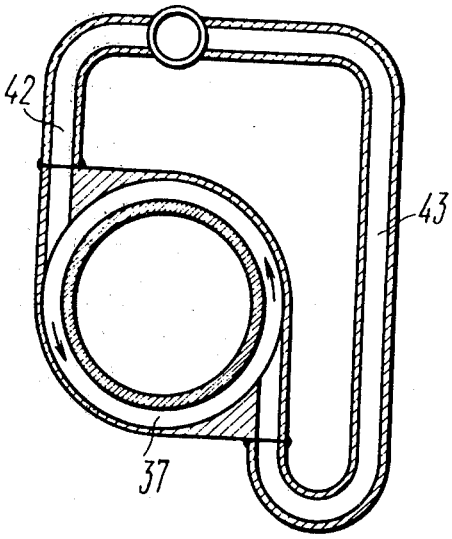
FIG. 8 is a sectional view taken along the line VIII—VIII in FIG. 3.

The ejector is composed of an outer ring 35 (FIG. 7) and an inner ring 36 defining therebetween an annular space 37 and an annular slit 38 for admitting compressed gas fed from a compressed gas source through a conduit 39 (FIG. 1), a valve 40, a flexible hose 41, the pipe 28 and conduits 42, 43 (FIG. 8).

The conduits 42, 43 are tangential with respect to the annular space 37 so as to create a gas flow rotating about the horizontal axis of the ejector.

The annular space 37 accommodates a ball 44 (FIG. 7) which is caused to rotate by the rotating gas flow to form a vibrating means to vibrate the working member.

During the displacement of the bar 5 (FIG. 1) to the foremost position, it is cantilevered relative to the support rollers 6 so that a heavy load is imposed on the rollers. In order to relieve this load, spring compensation means are mounted on the suction nozzle, each consisting of a sleeve 45, a compensation spring 46 and a sleeve 47.

The axis of the compensation spring 46 is inclined at an acute angle $\alpha$ with respect to the operating platform 2 so that the force P of the spring can be resolved into a vertical force $P_a$ and a horizontal force $P_b$. When the distance between the bar 5 and the operating platform 2 decreases, the compensation spring 46 is compressed, and the force P increases, but the angle $\alpha$ diminishes. In this case, the horizontal force $P_b$ increases, while the vertical force $P_a$ only slightly changes. The force $P_a$ compensates for an offset application of load from the bar, reduces the reactions $R_1$ and $R_2$ on the support rollers 6 and enables a shorter spacing *b* therebetween, thereby reducing the size of the arrangement as whole.

Figure 9:
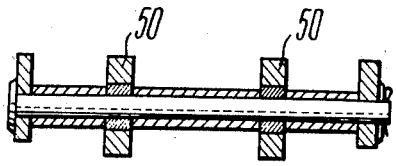
FIG. 9 is a sectional view taken along the line IX—IX in FIG. 1.

The arrangement is accommodated in a housing 48 which is mounted on the forward portion of a coke pusher 49 and is provided with rollers 50 (FIG. 9). The rollers 50 are adapted to hold, the working member in the initial position which is shown with dash-and-dot line in FIG. 1. It should be noted that a spacing *c* is provided between the working member in the initial position and the operating platform 2. The arrow "D" in FIG. 1 indicates the compressed gas supply from an appropriate source, the arrow "E" in FIG. 3 indicates the direction of flow of the ejected atmospheric air, and the arrow "P" indicates the direction of flow of a mixture of gas and ejected atmospheric air.

The above-described arrangements functions as follows:

After a door (not shown) has been removed from the oven 3, the remainders of coke 20 fall down on the operating platform 2 of the oven 3 and on the bottom part 19 of the oven. Then the coke pusher 49 pushes a cake out from the chamber 4 of the oven, whereafter the pusher is stopped in a position such that the above-described arrangement is located opposite to the oven chamber 4.

Thus, the working member 1 is in the transport position.

To put the arrangement in operation, the electric motor 7 is energized to extend the bar 5 forwardly towards the oven via the clutch 8, reducer gear 9, sprocket 10, chain 11, cluster of sprockets 12 and a roller chain 13 which runs below the driving bar 5. Thus, the working member 1, which has been in the transport position, leaves the rollers 50 to move down and engage with its wheels 18 the operating platform 2 and moves forward while maintaining a constant predetermined spacing *a* between the lower edge of the nozzle bellmouth and the operating platform 2 of the oven independently of the relative vertical position of the coke pusher and the operating platform of the oven, the working member sliding with its projections 22 in the guiding slots 21 of the bar 5.

After the working member 1 has reached the remainders of coke 20, the valve 40 is actuated, and compressed gas is admitted, via the flexible hose 41, pipe 28 and conduits 42, 43, into the space 37 of the ejector 34 and flows out through the slit 38 to reduce pressure. The atmospheric air flowing into the bellmouth of the suction nozzle as indicated by the arrow "E" entrains the remainders of coke into the curved pipe 17 and therefrom into the cylindrical portion of the delivery nozzle 16 to project them into the oven chamber 4. It should be noted that the compressed gas admitted into the annular space 37 of the ejector via the conduits 42, 43 whose axes are tangential to the annular space at the inlet thereof flows in the direction indicated by arrows in FIG. 8 to create a stream rotating about the ejector axis which entrains the ball 44 into the annular space. The ball rotates about the ejector axis to cause vibration of the working member due to the action of centrifugal forces.

Thus, the bellmouth of the suction nozzle caused to vibrate in the plane normal to the ejector axis readily penetrates the mass of the remainders of coke. Therefore, the remainders of coke moving in the stream of the ejected atmospheric air along the bellmouth 15 of the suction nozzle, curved pipe 17, and cylindrical portion of the delivery nozzle 16 are caused to vibrate so that the friction therebetween is reduced.

However, the inlet area of the bellmouth of the suction nozzles is by several times greater than the area of the pipe 17 and the cylindrical portion of the delivery nozzle 16 so that the velocity of the ejected atmospheric air (which flows in the direction indicated by the arrow E in FIG. 3) is relatively low. This velocity may prove to be insufficient for the conveyance of the remainders of coke so that a stronger pressure reduction in the ejector may be required resulting in an increased compressed gas consumption. In order to overcome this difficulty, compressed gas is fed via the conduit 27 into the slit 30 through the spaces 25 and 26.

The slit, which extends lengthwise the entire lower edge 23 of the bellmouth 15 of the suction nozzle directs the compressed gas stream over the entire lower plane 29 of the nozzle bellmouth.

The compressed gas leaving the slit 30 blows off the remainders of coke entering the bellmouth into the narrower portion of the nozzle, wherein the velocity of the ejected air is sufficient for their conveyance, while the compressed gas leaving the apertures 31 blows off the remainders of coke remaining in the space *a* between the operating platform and the lower edge of the nozzle bellmouth and effects the air - suspension of the entire mass of the remainders of coke to accelerate their suction in the nozzle.

Thus, the nozzle will suck in all remainders of coke and operate economically independently of the inlet width and area of the bellmouth.

When extended into the end position, the suction nozzle covers the bottom part 19 of the oven, and the compressed gas admitted via the conduits 33 to the apertures 32 at the forward top portion of the bellmouth of the suction nozzle blows off the remainders of coke from the bottom part 19 of the oven into the nozzle bellmouth.

Thus, the working member embraces the entire mass of the remainders of coke to completely collect them and to project all the remainders of coke into the oven chamber.

After the coke pusher has been transferred to another oven, the level of the operating platform relative to the coke pusher 49 is changed, but, when the working member is displaced towards the oven, the vertical force $P_a$ of the compensation spring 46 remains substantially unchanged so that the load imposed on the support rollers 6 also remains unchanged.

Upon removing the remainders of coke, the bar 5 is retracted from the oven 3 together with the working member 1. The working member reaches the rollers 50 and runs over them with the bottom portion thereof to be commed upwardly and take the initial position above the operating platform 2 with the spacing *c* due to the cooperation of the guides 21 of the bar 5 with the projections 22. In this position the arrangement is ready to perform the next operation cycle.

The arrangement is controlled by the operator of the coke pusher from the cabin thereof.

It will thus be seen that the structure of the invention includes the working member 1 which comprises the lower suction nozzle formed by the bellmouth 15 and the upper discharge nozzle formed by the cylindrical pipe 16, the suction and discharge nozzles respectively having substantially parallel horizontal axes with the axis of the discharge nozzle 16 being situated above the axis of the suction nozzle 15. These nozzles have open front ends directed forwardly toward the coke oven and they also have open rear ends interconnected by the curved pipe 17. It will be noted that the upper discharge nozzle 16 projects forwardly through a considerable distance beyond the open front end of the lower suction nozzle 15. These nozzles together with the curved pipe 17 define an interior flow path communicating through the annular chamber 37 and the pipes 42 and 43 (FIG. 8) with a source of fluid under pressure for directing air along this flow path inwardly through the suction nozzle around through the interior of the curved pipe 17 and outwardly through the discharge nozzle 16. A vibrating means is operatively connected with the working member 1 to vibrate the latter, this vibrating means being formed by the ball 44 (FIG. 7) which is entrained in the air which rotates in the chamber 37 in the manner indicated in FIG. 8.

As may be seen particularly from FIG. 3, the suction nozzle 15 has an upper wall extending forwardly through a substantial distance beyond the front open end of the suction nozzle and provided with the apertures 32 which form a pair of nozzles communicating through the pipes 33 with the source of fluid under pressure so that through these nozzles 32 streams of air can be directed downwardly in front of the open end of the suction nozzle 15 to aid in the removal of pitch-bonded remainders of coke, and it will be seen that while the nozzles 32 are situated forwardly of the front open end of the suction nozzle 15 they are still situated rearwardly of the front open end of the discharge nozzle 16.

Figure 5:
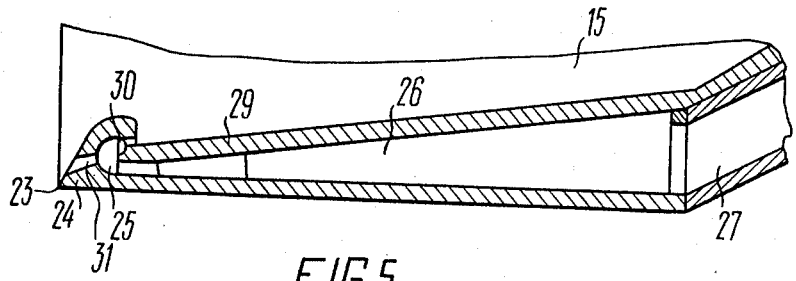
FIG. 5 is a detail "A" in FIG. 3.

As may be seen from FIG. 5, the front edge of the lower wall 29 of the suction nozzle 15 extends into the interior of the elongated channel 25 which defines with the upper surface of the wall 29 at the region of the front edge thereof the slit through which air is directed inwardly along the upper surface of the lower wall 29, this channel 25 communicating also with the source of fluid under pressure through the pipe 27. The channel 25 is formed forwardly of the front edge of the bottom wall 29 with the apertures or nozzles 31 through which air is directed from the interior of the channel 25 forwardly and downwardly to provide for the air-suspension of particles to assist in the removal thereof.

Figure 2:
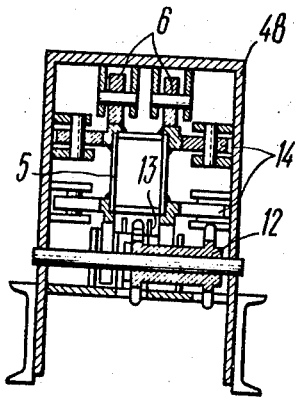
FIG. 2 is a sectional view taken along the line II—II in FIG. 1.
Figure 4:
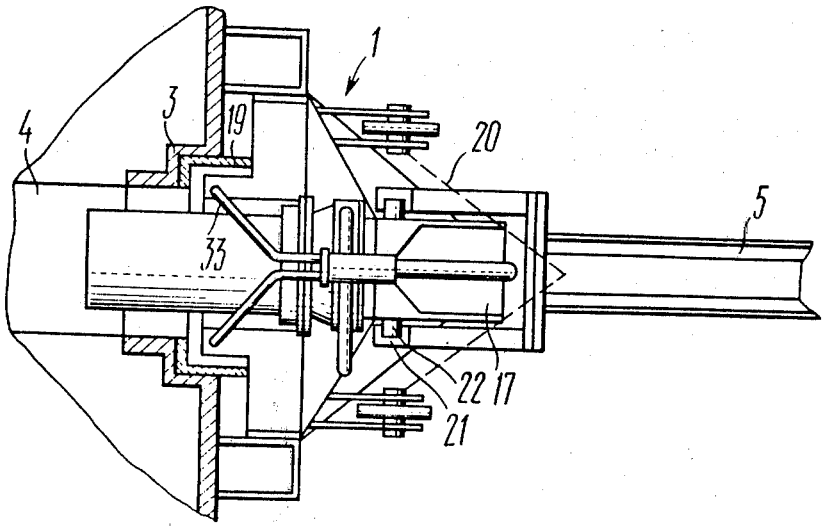
FIG. 4 is a sectional view taken along the line IV—IV in FIG. 1.

A moving means is operatively connected with the working member 1 to move the latter from the retracted rest position shown in dot-dash lines in FIG. 1 forwardly along the platform 2 toward the oven 3 up to the end position shown in FIG. 4 as well as in solid lines in FIG. 1, whereupon the moving means will retract the working member 1 back to its rest position. This moving means includes the elongated bar 5 and the structure connected thereto for displacing the bar 5 first forwardly and then rearwardly. As the working member 1 moves forwardly and rearwardly it is capable of engaging the platform 2 by way of the rollers 18 while the bar 5 and the working member 1 are capable of free vertical displacement one with respect to the other by way of the guide means 21, 22, and it will be seen that the assembly 45–47 forms a spring means interconnecting the bar 5 with the working member 1 while the latter engages the platform 2 by way of the rollers 18 so that the spring means 45–47 will form a compensating means to compensate for the increased load on the bar 5 which would be provided if this compensating means were not present. In addition it will be noted that the rollers 50 carried by the frame means which supports the bar 5 for movement cooperate with the lower rear portion of the working member 1 to cam the latter upwardly to the rest position shown in dot-dash lines in FIG. 1 while during forward movement from this rest position the working member 1 will freely move downwardly toward the platform 2 in order to provide the relatively small space maintained between the working member 1 and the platform 2 when the rollers 18 engage the platform 1.

What is claimed is:

1. In an apparatus for removing coke remainders from the platform of a coke oven, a working member comprising a lower suction nozzle, an upper discharge nozzle situated at an elevation higher than said lower suction nozzle, both of said nozzles having front open ends adapted to be directed toward a coke oven, and both of said nozzles also having open rear ends, said working member further including a curved pipe connected with and providing communication between said rear ends of said suction and discharge nozzles to define therewith a flow path entering into said suction nozzle through said open end thereof, curving along the interior of said curved pipe, and extending from said curved pipe forwardly along the interior of said discharge nozzle and through said front open end of the latter, gas-supply means communicating with said working member at a location between said open ends of said suction and discharge nozzles for supplying gas under pressure to the interior of said working member to provide for a flow of gas along said flow path, and moving means operatively connected with said working member for moving the latter first forwardly from a retracted rest position along a platform toward a coke oven up to a forward end position situated at the coke oven and then rearwardly from said forward end position back to said retracted rest position, so that during movement from said retracted rest position to said forward end position while said gas-supply means supplies gas to said flow path coke remainders will be sucked into said suction nozzle and propelled out from said discharge nozzle back to the interior of a coke oven, and vibrating means operatively connected with said working member for vibrating the latter at least during part of the forward movement of said working member from said retracted rest position toward said forward end position.

2. The combination of claim 1 and wherein said gas-supply means includes an annular chamber surrounding said working member between said open ends of said suction and discharge nozzles, and said working member being formed in its interior with an annular slit through which said chamber communicates with the interior of said working member to release gas under pressure from said chamber into said working member to create a flow of gas along said flow path, said gas supply means including at least one supply tube communicating tangentially with said chamber to create thererin a flow of gas travelling around said working member before discharging through said slit into the interior of said working member, and said vibrating means including a ball member situated in said chamber for free movement therein and adapted to be entrained by the gas flowing in said chamber to travel around the interior thereof and by centrifugal force strike against and vibrate said working member.

3. In an apparatus for removing coke remainders from the platform of a coke oven, a working member comprising a lower suction nozzle, an upper discharge nozzle situated at an elevation higher than said lower suction nozzle, both of said nozzle having front open ends adapted to be directed toward a coke oven, and both of said nozzles also having open rear ends, said working member further including a curved pipe connected with and providing communication between said rear ends of said suction and discharge nozzles to define therewith a flow path entering into said suction nozzle through said open end thereof, curving along the interior of said curved pipe, and extending from said curved pipe forwardly along the interior of said discharge nozzle and through said front open end of the latter, gas-supply means communicating with said working member at a location between said open ends of said suction and discharge nozzles for supplying gas under pressure to the interior of said working member to provide for a flow of gas along said flow path, and moving means operatively connected with said working member for moving the latter first forwardly from a retracted rest position along a platform toward a coke oven up to a forward end position situated at the coke oven and then rearwardly from said forward end position back to said retracted rest position, so that during movement from said retracted rest position to said forward end position while said gas-supply means supplies gas to said flow path, said coke remainders will be sucked into said suction nozzle and propelled out from said discharge nozzle back to the interior of a coke oven, said upper discharge nozzle having a substantially horizontal axis and extending through a substantial distance forwardly beyond said open end of said lower suction nozzle so that when said working member is at said forward end position thereof said suction nozzle can be situated directly at the door of a coke oven while said upper discharge nozzle can extend to a substantial distance into the interior of the coke oven, said suction nozzle also having a substantially horizontal axis and said suction nozzle having an upper wall extending forwardly beyond said open front end of said suction nozzle but terminating rearwardly of the front open end of said discharge nozzle, and at least one additional nozzle situated at said upper wall of said suction nozzle forwardly of said open end thereof but rearwardly of said front open end of said discharge nozzle and communicating with said gas-supply means for directing gas under pressure downwardly toward a surface in front of said front open end of said suction nozzle to contribute toward loosening of remainders such as pitch-bonded remainders, so that the latter thus-loosened remainders will be received in said suction nozzle.

4. In an apparatus for removing coke remainders from the platform of a coke oven, a working member comprising a lower suction nozzle, an upper discharge nozzle siturated at an elevation higher than said lower suction nozzle, both of said nozzles having front open ends adapted to be directed toward a coke oven, and both of said nozzles also having open rear ends, said working member further including a curved pipe connected with and providing communication between said rear ends of said suction and discharge nozzles to define therewith a flow path entering into said suction nozzle through said open end thereof, curving along the interior of said curved pipe, and extending from said curved pipe forwardly along the interior of said discharge nozzle and through said front open end of the latter, gas-supply means communicating with said working member at a location between said open ends of said suction and discharge nozzles for supplying gas under pressure to the interior of said working member to provide for a flow of gas along said flow path, and moving means operatively connected with said working member for moving the latter first forwardly from a retracted rest position along a platform toward a coke oven up to a forward end position situated at the coke oven and then rearwardly from said forward end position back to said retracted rest position, so that during movement from said retracted rest position to said forward end position while said gas-supply means supplies gas to said flow path coke remainders will be sucked into said suction nozzle and propelled out from said discharge nozzle back to the interior of a coke oven, said suction nozzle having a bellmouth configuration and including a lower edge long enough to extend substantially completely across a platform of a coke oven, so that the entire operating cycle can be completed during one forward stroke and one rearward stroke of said working member forwardly from and back toward said retracted rest position thereof, said suction nozzle including a lower wall terminating in a front edge and an elongated hollow channel receiving said front edge of said lower wall in its interior and defining therewith said lower edge of said suction nozzle, said gas-supply means communicating with said channel for supplying thereto gas for cooling said lower edge of said suction nozzle.

5. The combination of claim 4 and wherein said channel defines with an upper surface of said lower wall of said suction nozzle adjacent said front edge of said lower wall a slit through which gas under pressure escapes along said upper surface of said lower wall into the interior of said suction nozzle to continue to flow along said flow path, whereby said lower edge of said suction nozzle not only is cooled but in addition the escape of gas through said slit contributes to the creation of gas flow along said flow path to carry remainders into said suction nozzle and along said flow path.

6. The combination of claim 5 and wherein said channel is formed with a plurality of openings extending from the interior of said channel forwardly away from said front edge of said lower wall and defining nozzles for directing gas under pressure along a surface situated directly in front of said lower edge of said suction nozzle for contributing to air-suspension of particles such as coke remainders so that the latter particles can then be more easily sucked into said suction nozzle.

7. In an apparatus for removing coke remainders from the platform of a coke oven, a working member comprising a lower suction nozzle, an upper discharge nozzle situated at an elevation higher than said lower suction nozzle, both of said nozzles having front open ends adapted to be directed toward a coke oven, and both of said nozzles also having open rear ends, said working member further including a curved pipe connected with and providing communication between said rear ends of said suction and discharge nozzles to define therewith a flow path entering into said suction nozzle through said open end thereof, curving along the interior of said curved pipe, and extending from said curved pipe forwardly along the interior of said discharge nozzle and through said front open end of the latter, gas-supply means communicating with said working member at a location between said open ends of said suction and discharge nozzles for supplying gas under pressure to the interior of said working member to provide for a flow of gas along said flow path, and moving means operatively connected with said working member for moving the latter first forwardly from a retracted rest position along a platform toward a coke oven up to a forward end position situated at the coke oven and then rearwardly from said forward end position back to said retracted rest position, so that during movement from said retracted rest position to said forward end position while said gas-supply means supplies gas to said flow path coke remainders will be sucked into said suction nozzle and propelled out from said discharge nozzle back to the interior of a coke oven, said moving means including an elongated substantially horizontal bar extending rearwardly from said working member and having a front end region operatively connected with said working member, said moving means further including support means supporting said bar for forward and rearward movement and a drive operatively connected with said bar for extending the latter forwardly from a rear rest position for displacing said working member forwardly from said rear retracted position thereof, and for retracting said bar rearwardly back to said rear rest position thereof after said working member has reached said forward end position thereof, and spring-compensating means compressed between and pivotally connected to said bar at a lower portion thereof adjacent said working member and to said working member at an elevation lower than said bar for compensating for the cantilever load which otherwise would be increasingly provided at said bar as said working member approaches said forward end position thereof.

* * * * *